United States Patent [19]

Olsson

[11] 4,450,352

[45] May 22, 1984

[54] METHOD AND DEVICE FOR COUNTING SHEET MATERIAL

[75] Inventor: Christer H. K. Olsson, Enskede, Sweden

[73] Assignee: Dagens Nyheters AB, Gothenburg, Sweden

[21] Appl. No.: 538,839

[22] Filed: Oct. 5, 1983

Related U.S. Application Data

[63] Continuation of Ser. No. 269,759, Jun. 2, 1981, abandoned.

[30] Foreign Application Priority Data

Jun. 4, 1980 [SE] Sweden ..... 8004165

[51] Int. Cl.[3] ..... G06M 7/06

[52] U.S. Cl. ..... 250/223 R; 377/8; 377/53

[58] Field of Search ..... 250/222.1, 222.2, 223 R, 250/560–563; 377/8, 53; 356/448

[56] References Cited

U.S. PATENT DOCUMENTS 4,027,155 5/1977 Rappaport ..... 250/222.1
4,112,309 9/1978 Nakazawa et al. ..... 250/560
4,217,491 8/1980 Dufford, Jr. et al. ..... 250/223 R
4,286,149 8/1981 Ben-Nathan et al. ..... 250/223 R
4,296,314 10/1981 Dabisch ..... 377/8

FOREIGN PATENT DOCUMENTS 1501162 2/1967 France .

*Primary Examiner*—David C. Nelms
*Assistant Examiner*—Edward P. Westin
*Attorney, Agent, or Firm*—Young & Thompson

[57] ABSTRACT

A laser beam, directed by mirrors at a conveyor belt with overlapping sheet products, is reflected against at least two measuring cells. Each paper edge passing the point of reflection is shown in the signals from the measuring cells, and by compositing the signals in various ways in a computer, disturbances due to varying amounts of color, thickness and form of the edges, folds etc. can be eliminated, producing a curve which exactly shows how many products have passed on the belt. Using a laser as a light source provides a parallely focusable, very powerful light beam, which makes it possible to count thin, tightly spaced and heavily colored products.

2 Claims, 3 Drawing Figures

METHOD AND DEVICE FOR COUNTING SHEET MATERIAL

This application is a continuation of application Ser. No. 269,759, filed June 2, 1981, now abandoned.

The present invention relates to a method and a device for counting overlapping sheet material.

Counting spaced objects presents no problem and can be done mechanically, magnetically, photoelectrically etc., but counting fish-scale-like overlapping products presents many problems. For flat products of uniform thickness with constant overlap, rather simple counters can produce exact results, but for printed matter, for example, of varying thickness coming from a printing press, and sometimes damaged with faults in the surface, varying overlap etc., a completely satisfactory counter has not been produced up to now, despite of the different designs to be found on the market.

Mechanical and electromechanical counters can sense the forward fold on each copy which passes, but very thin copies cannot be sensed mechanically, and miscounts can easily occur due to creases, bulges or the like. Nor can closely spaced copies be counted even if the mechanical sensors are set and adjusted with great care.

To remedy these deficiencies, photoelectric counters have also been tried, in which a beam of light is directed obliquely against the printed product in its direction of motion.

The disadvantage of this is that the photocell can react to dark places, i.e. very black print, and the reading is not distinct for thin copies.

The light from an ordinary source of light cannot be focused or be made completely parallel even with a rather large system of lenses. If a powerful light beam is desired, a very high input power will be required causing considerable heat to be produced.

According to the present invention however, a laser is used as a light source, thus producing a very strong, parallel luminous beam. This makes it possible to count very thin copies; it has been shown to be effective for counting copies as thin as two sheets.

Furthermore, by virtue of the exact parallel light of the laser beam, the spacing between the copies can be reduced to a minimum. It is possible to keep an exact count with a spacing between the fish-scales of as little as one half centimeter or less.

Figure 1:
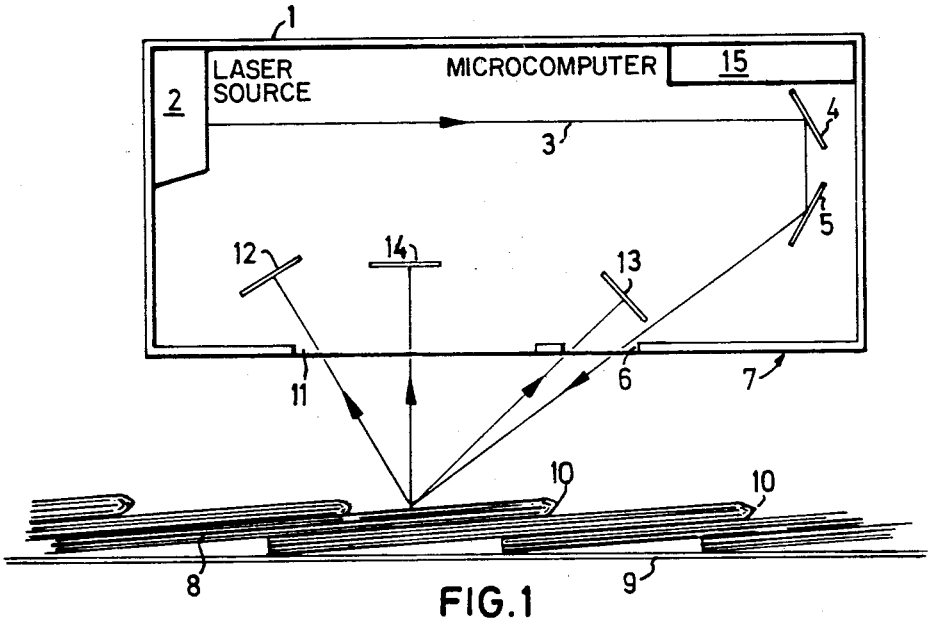
Figure 2:
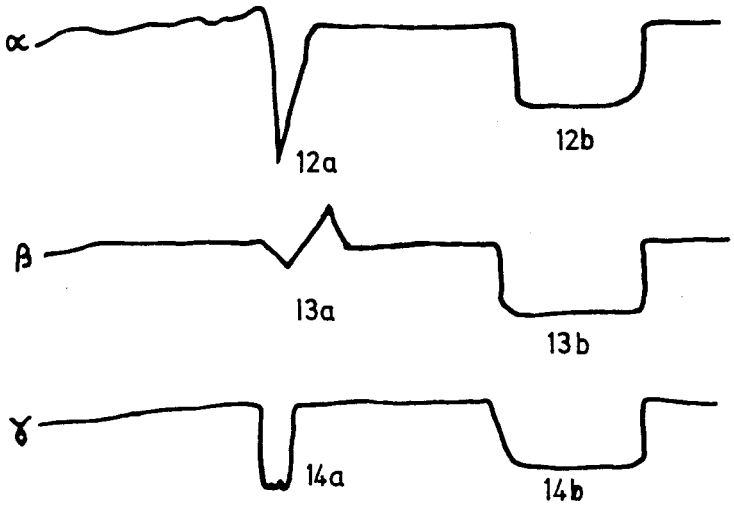
Figure 3:
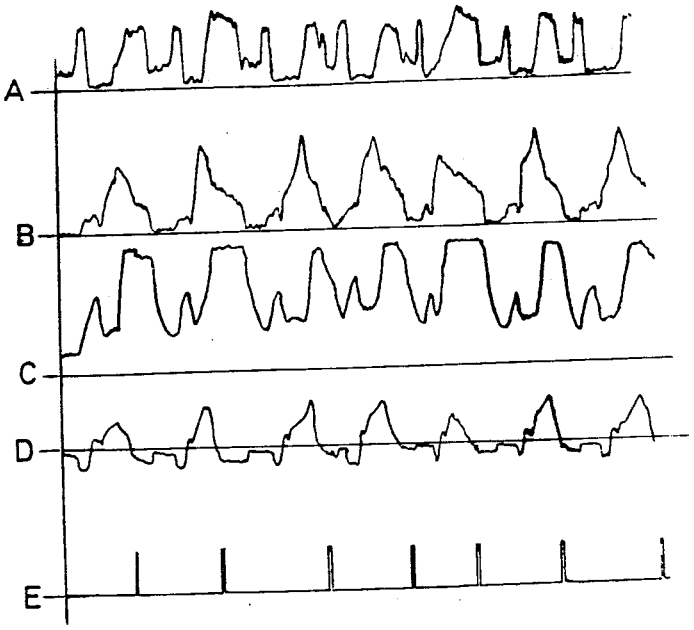

According to the invention, three measuring cells are used to register the reflective light from the copies with a computer which processes the signal according to a set program, thus providing an exact count regardless of the blackness of the copies, or the spacing and thickness of the copies. The invention will be described below in more detail with reference to an example illustrated in the accompanying drawings, of which FIG. 1 shows a copy counter according to the invention, FIG. 2 shows the readings of the measuring cells, and FIG. 3 shows the signal curves obtained for "normal" counting of newspapers.

The device according to the invention can however be modified in various ways according to the desired use, and can be used to advantage for many different purposes where ordinary mechanical or photoelectrical counters produce unsatisfactory results.

In an apparatus box 1, the laser 2 is mounted together with a voltage unit etc. The beams of light 3 from the laser are reflected in a first mirror 4 and a second mirror 5 exiting through a hole 6 in the bottom 7 of the box towards the newspaper line under the box.

The newspapers 8 are fed lying overlapped like fish-scales on a conveyor belt 9. The laser beam strikes the forward edge 10 of the newspapers at an oblique angle and is reflected through a hole 11 in the box bottom striking three sensors 12,13,14, which send signals to a microcomputer 15, which is programmable in various ways depending on the nature of the products to be counted; thin or thick newspapers, the shape of the backs etc.

The signals can also be amplified individually before being fed into the computer.

The angle between the laser beam and the conveyor belt should be kept less than 90°, preferably less than 45°, and for thin products it can be desirable to reduce the angle to 30° or less to keep the count exact. Angle adjustments can be made simply by turning or moving the mirrors.

FIG. 2 shows the reflection from the newspaper on an ordinary newspaper conveyor with the curves $\alpha$, $\beta$ and $\gamma$ from the different sensers.

The curve $\alpha$ shows a distinct peak for each newspaper back which passes the laser beam. The strength of the signal is of course dependent on the blackness of the portion of the copy from which the light is reflected, but even if the copy is completely black, the peak will be distinct.

The sensor 12 is placed in the beam direction, approximately as far behind the point of reflection as the beam source is in front of it.

A second measuring cell or sensor 13 is placed in front of the point of reflection immediately beside the source of light. With this placement, a newspaper back 10, which is pointed, will, upon passing the beam of light, cut off almost all reflection to the sensor 12, while almost maintaining the reflection to the sensor 13.

A third sensor 14 is placed approximately directly above the point of reflection.

FIG. 2 shows schematically the readings of the different measuring cells for a newspaper back and a black surface at the point of reflection. The back of the newspaper or a fold produces a sharp reduction of the reflection, **12*a*,13*a*,14*a*, with a sharp upward movement when the back has passed. The reduction is of different size for the measuring cells 12 and 13**, and a composite of these curves ($\beta-\alpha$) produces a peak on the difference curve.

A black surface produces, on the other hand, a reduction **12*b*,13*b*,14*b*** which is of approximately the same size for the different measuring cells, and a composite produces a difference curve which is approximately flat, i.e. the effect of color is eliminated, and the counting is not disturbed by different amounts of color in the products.

The third measuring cell 14 has inter alia the function of counting the first copy in a series. For this copy, which lies flat on the conveyor belt, the readings from measuring cells 12 and 13 will be about the same size, especially if the back is straight or very thin, and no composite peak appears on the difference curve $\beta-\alpha$. The measuring cell 14 does however give a distinct reading, and the computer can be programmed to count this reading.

Curves obtained in the counting of normal newspapers are shown in FIG. 3, in which curve A corresponds to measuring cell 12; B to measuring cell 13; and C to measuring cell 14. D is the composite curve B−A, and E is the output signal curve.

The computer program does a signal analysis with a number of different functions, inter alia level discrimination, difference and time calculations, etc. Additional measuring cells and/or measuring cells with special features can be incorporated.

What I claim is:

1. Apparatus for counting overlapping objects such as newspapers, printed matter and the like, comprising means for advancing the objects in a single plane in a series with their overlapping edges facing all in the same direction, means for directing an exact parallel light laser beam obliquely against the objects in a direction opposite said facing direction of the overlapping edges at an acute angle to said plane and to an imaginary line which is perpendicular to said plane, at least two measuring cells for detecting the light of the laser beam that is reflected from the objects, one said cell being positioned to receive light that is reflected along one line that is inclined at an acute angle to said plane on the opposite side of said imaginary line from said beam, another of said cells being positioned to receive light that is reflected along another line that is disposed between said one line and said laser beam, whereby the overlapping edge of each object, upon reaching the vicinity of said one line, will produce a diminution of the quantity of light reflected along said one line relative to the quantity of light reflected along said another line, and means for counting said diminutions as a measure of the number of said objects whose overlapping edges pass through said beam.

2. In a method of counting overlapping objects such as newspapers, printed matter and the like by reflecting a beam from a light source against the objects to be counted, and measuring the reflected light; the improvement in which the beam which strikes the objects is an exact parallel light laser beam, advancing the overlapping objects in a single plane in a series with their overlapping edges facing all in the same direction, directing the laser beam obliquely against the objects in a direction opposite said facing direction of the overlapping edges at an acute angle to said plane and to an imaginary line which is perpendicular to said plane, detecting the light of the laser beam which is reflected from the objects by means of at least two measuring cells that are positioned to receive said light that is reflected along at least two different lines that are positioned at different angles relative to said direction of advance, one of said lines of reflection being inclined at an acute angle to said plane on the opposite side of said imaginary line from said beam, another of said lines being disposed between said one line and said laser beam, whereby the overlapping edge of each object upon reaching the vicinity of said one line, will produce a diminution of the quantity of light reflected along said one line relative to the quantity of light reflected along said another line, and counting said diminutions as a measure of the number of said objects whose overlapping edges pass through said beam.

* * * * *